US007219891B2

(12) United States Patent
Giegerich et al.

(10) Patent No.: US 7,219,891 B2
(45) Date of Patent: May 22, 2007

(54) VIRTUAL GOAL FOR A GAME TABLE

(75) Inventors: Gary Giegerich, Glenside, PA (US); Paul Giegerich, Maple Glen, PA (US); Edmond J. Dougherty, Wayne, PA (US)

(73) Assignee: DMI Sports, Inc., Fort Washington, PA (US)

( * ) Notice: Subject to any disclaimer, the term of this patent is extended or adjusted under 35 U.S.C. 154(b) by 267 days.

(21) Appl. No.: 11/001,284

(22) Filed: Dec. 1, 2004

(65) Prior Publication Data

US 2005/0127601 A1 Jun. 16, 2005

Related U.S. Application Data

(60) Provisional application No. 60/529,773, filed on Dec. 16, 2003.

(51) Int. Cl.
*A63B 67/14* (2006.01)

(52) U.S. Cl. ..... 273/108

(58) Field of Classification Search ..... 273/108.1, 273/108, 317.1, 108.51–108.56, 379, 118 R, 273/119 R, 118 A, 126 R, 126 A, 237, 108.5, 273/371, 378, 317; 473/29, 115, 476, 478, 473/480

See application file for complete search history.

(56) References Cited

U.S. PATENT DOCUMENTS 3,466,042 A 9/1969 Lucci
3,907,293 A 9/1975 Werner
4,032,150 A 6/1977 Wilson
4,274,635 A 6/1981 Pakogian
4,765,622 A * 8/1988 Rienzo ..... 273/108.5
4,775,152 A 10/1988 Roehl
4,927,145 A 5/1990 Davis
4,971,324 A 11/1990 Grabel et al.
5,029,861 A 7/1991 Driska
5,110,128 A * 5/1992 Robbins ..... 273/126 A
5,161,801 A * 11/1992 Kazuk ..... 273/126 A
5,186,461 A 2/1993 Tucker
5,222,737 A * 6/1993 Kazuk ..... 273/126 A
5,356,135 A * 10/1994 Montgomery ..... 473/434
5,556,093 A * 9/1996 Lankiewicz et al. .... 273/126 A
5,931,465 A 8/1999 Miyake et al.
6,234,476 B1 * 5/2001 Yamashita et al. ..... 273/126 A
6,276,682 B1 8/2001 Yamashita et al.
6,345,820 B1 * 2/2002 Zucchi et al. ..... 273/148 R
2003/0125103 A1 7/2003 Tessmer et al.

* cited by examiner

*Primary Examiner*—Robert E. Pezzuto
*Assistant Examiner*—Dat T. Nguyen
(74) *Attorney, Agent, or Firm*—Akin Gump Strauss Hauer & Feld LLP

(57) ABSTRACT

A game table for playing a game with a gamepiece includes a playing surface and the gamepiece is movable along the playing surface through the application of gaming forces. A first endwall extends generally perpendicularly from the playing surface and has a first wall length. A second endwall extends generally perpendicularly from the playing surface and is located on an opposite side of the playing surface from the first endwall. A first goal, comprised of at least one proximity sensor, is located along the first endwall and has a first goal length. The first goal length is adjustable.

3 Claims, 4 Drawing Sheets

VIRTUAL GOAL FOR A GAME TABLE

CROSS-REFERENCE TO RELATED APPLICATIONS

This application claims the benefit of U.S. Provisional Patent Application No. 60/529,773, filed Dec. 16, 2003 and entitled "Virtual Goal for a Game Table", and is incorporated herein by reference.

BACKGROUND OF THE INVENTION

The present application relates to a game table for playing a game with a gamepiece and, more particularly, to a game table having virtual goals comprised of proximity sensors that may be actuated to on and off conditions to modify a size of the goal, handicap the game and/or play a number of alternate games that do not include goals.

Conventional game tables include goals having a fixed size and a fixed position. When playing such games, for example, table hockey or foosball, the object of the game is to direct a gamepiece into your opponent's goal. These conventional game tables are incapable of handicapping the game when a vastly superior player competes against a less skilled player and are limited to the specific game that the game table is configured to play.

The game table of the present invention includes goals having a size that may be altered to handicap a specific game or to make the game more challenging for players of different levels of skill. In addition, the same game table may be set up to play a plurality of different games without altering the table itself. The game table of the present invention provides a game table that may be adapted to play table games in a number of exciting configurations and to play a number of different games.

BRIEF SUMMARY OF THE INVENTION

The present application is directed to a game table for playing a game with a gamepiece and includes a playing surface. The gamepiece is moveable along the playing surface through the application of game forces. A first endwall extends generally perpendicularly from the playing surface and has a first wall length. A second endwall extends generally perpendicularly from the playing surface and is located at an opposite side of the playing surface from the first endwall. A first goal is located along the first endwall and has a first goal length that is adjustable.

In another aspect, the present application is directed to a method of playing a table game on a game table having a gamepiece. The game table includes a first endwall, a second endwall, a first sidewall, a second sidewall and a playing surface. A first plurality of sensors are mounted proximate the first endwall and a second plurality of sensors is mounted proximate the second endwall. The first and second plurality of sensors are each actuable between an on condition and an off condition. A control circuit is in communication with the first and second plurality of sensors. The method of playing the table game includes the steps of activating a first bank of the first plurality of sensors to the on condition, actuating a second bank of the first plurality of sensors to the off condition, applying a force to the gamepiece propelling the gamepiece toward the first endwall and transmitting a signal to the control circuit when the gamepiece enters a sensing area of at least one of the sensors that is associated with the first bank.

In a further aspect, the present application is directed to a table hockey game table with an adjustable goal for modifying a difficulty of the game or handicapping the game. The table hockey game table includes a playing surface and a first endwall that extends generally perpendicularly from the playing surface. At least one first proximity sensor is mounted proximate the first endwall. A second endwall extends generally perpendicularly from the playing surface and is positioned opposite the first endwall. At least one second proximity sensor is mounted proximate the second endwall. First and second sidewalls extend between and separate the first and second endwalls.

BRIEF DESCRIPTION OF THE SEVERAL VIEWS OF THE DRAWINGS

The foregoing summary, as well as the following detailed description of preferred embodiments of the invention described in the present application, will be understood when read in conjunction with the appended drawings. For the purpose of illustrating the invention of the present application, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
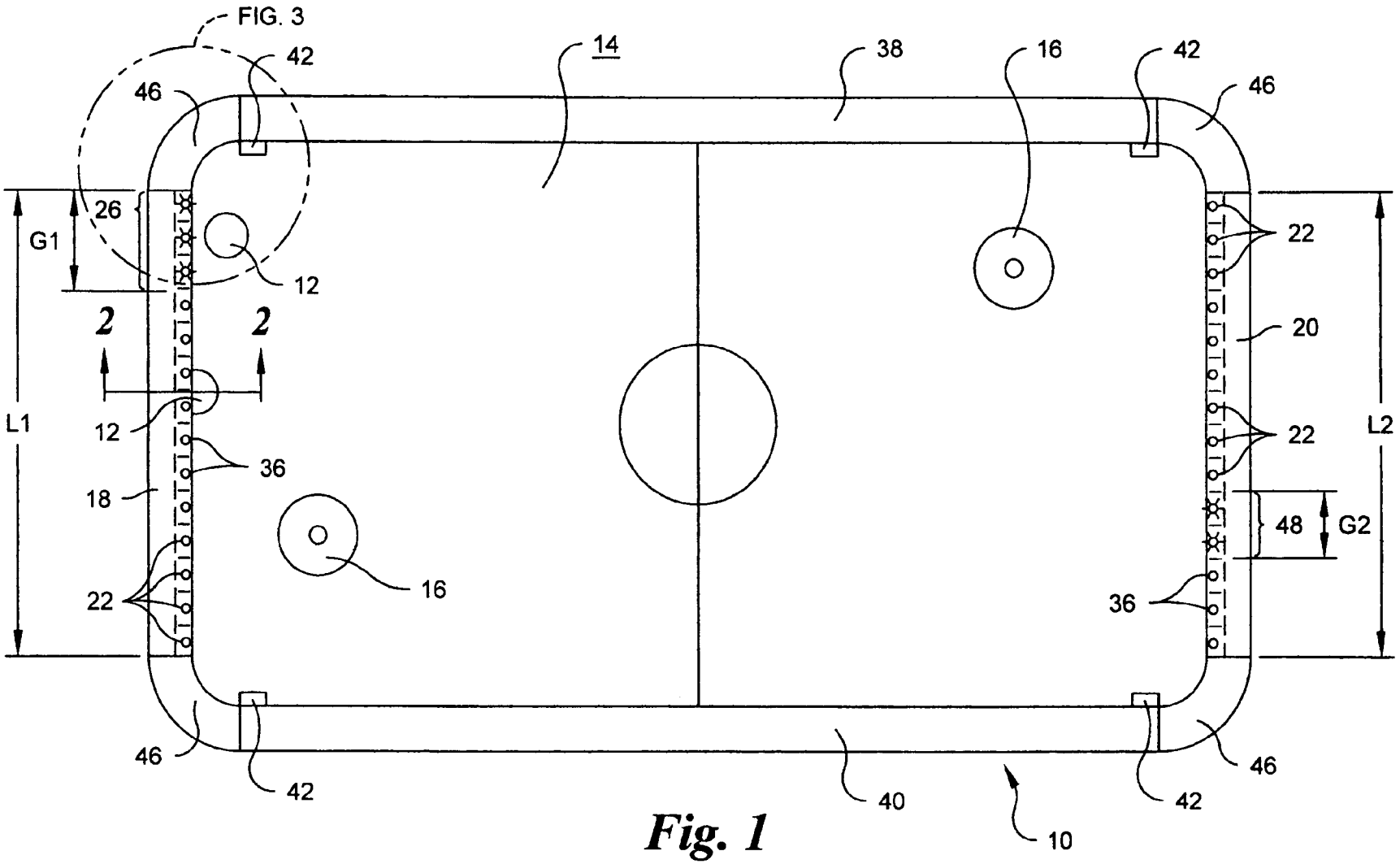
FIG. 1 is a top plan view of a game table in accordance with a first preferred embodiment of the present invention.

Certain terminology is used in the following description for convenience only and is not limiting. The words "right", "left", "lower", and "upper" designate directions in the drawings to which references are made. The words "inwardly" and "outwardly" refer to directions toward and away from, respectively, the geometric center of the game table and designated parts thereof. The terminology uses the above-listed words, derivates thereof and words of similar import.

Referring to the drawings in detail, wherein like numerals indicate like elements throughout, there is shown in FIGS. 1–5, first and second preferred embodiments of a game table, generally designated 10, 10', for playing a game with a gamepiece 12 in accordance with the present invention. The game tables 10, 10' include a playing surface 14 and the gamepiece 12 is movable along the playing surface 14 through the application of gaming forces. For example, in the preferred embodiments, the gamepiece 12 may be comprised of a puck 12 for a table hockey table 10, 10'. The puck 12 is movable along the playing surface 14 by applying gaming forces using paddles 16 or simply by propelling the puck 12 with a player's hand. Alternatively, the gamepiece 12 may be comprised of a foosball (not shown) that is movable along the playing surface 14 of a foosball table by players attached to rotatable rods (not shown) extending over the playing surface 14. One having ordinary skill in the art will realize that the gamepiece 12 is not limited to the puck or foosball described above and may be comprised of nearly any similar type of gamepiece 12 that is movable along the playing surface 14. In addition, the game tables 10, 10' are not limited to a specific type of table game configuration and may be comprised of nearly any type of game that is played on a table and includes a gamepiece 12.

Figure 2:
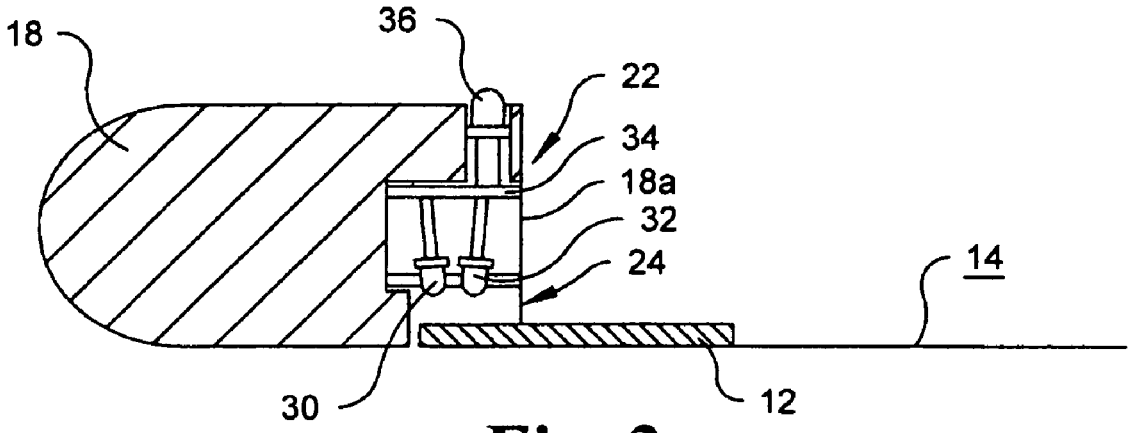
FIG. 2 is a cross-sectional view of a first endwall of the game table, taken along line 2—2 of FIG. 1.
Figure 5:
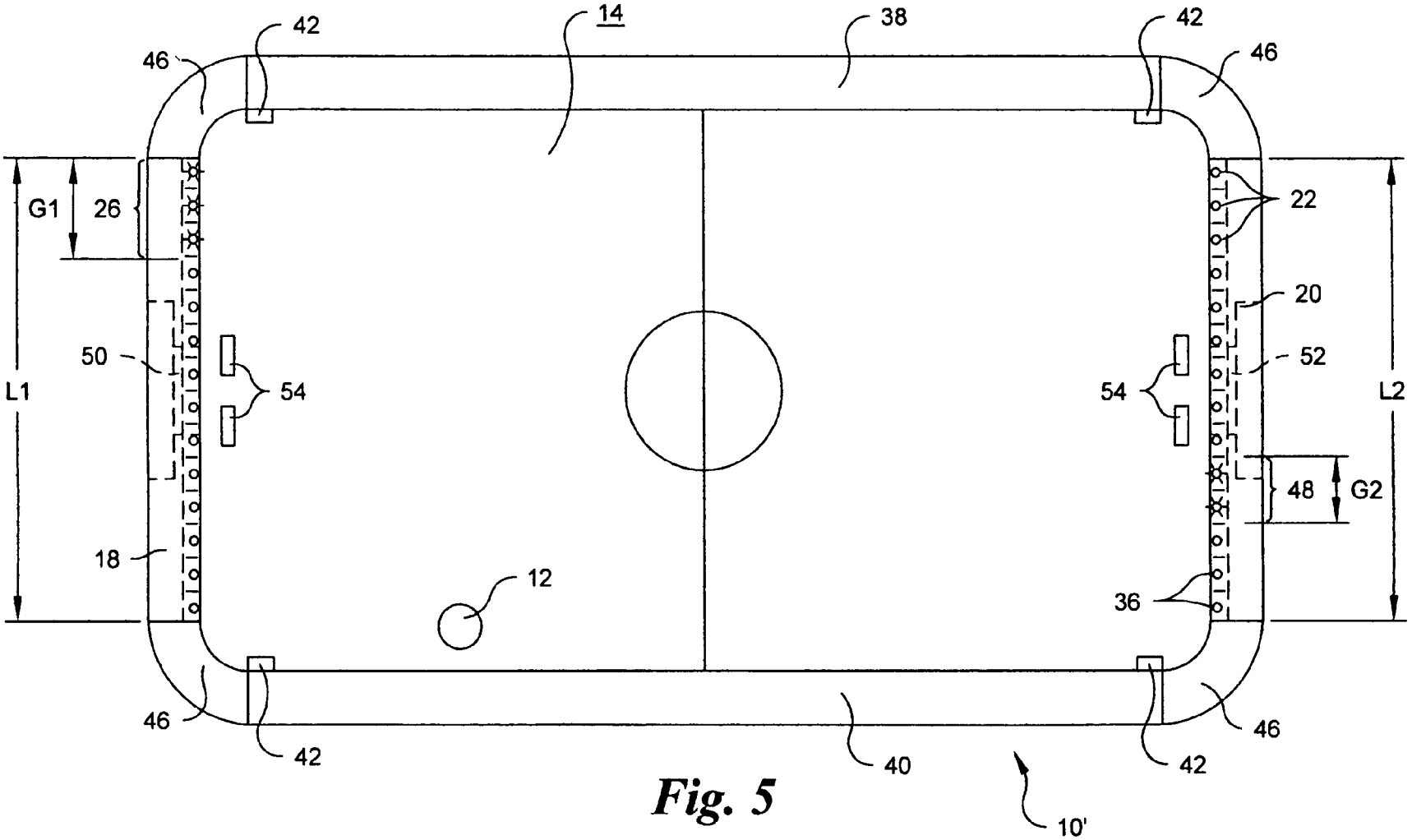
FIG. 5 is a top plan view of a game table of a second preferred embodiment of the present invention.

Referring to FIGS. 1, 2 and 5 the game tables 10, 10' of the first and second preferred embodiments also include a first endwall 18 that extends generally perpendicularly (upwardly) from the playing surface 14. The first endwall 18 has a first wall length L1 that extends from a first lateral end to a second lateral end of the first endwall 18. The preferred game tables 10, 10' also include a second endwall 20 that also extends generally perpendicularly (upwardly) from the playing surface 14. The second endwall 20 is preferably located at an opposite side of the playing surface 14 from the first endwall 18. The second endwall 20 extends from a first to a second lateral end and has a second wall length L2. In the preferred embodiments, the first and second endwalls 18, 20 extend in a straight line between the first and second lateral ends and are generally parallel to each other at opposite sides of playing surface 14. The first and second endwalls 18, 20 are not limited to extending along the first and second wall lengths L1, L2 in a straight line and may extend along a curve between the first and second ends or in nearly any path that extends between the first and second lateral ends. However, the first and second walls 18, 20 are preferably positioned at opposite sides of the playing surface 14 such that one player may play the game from a side adjacent the first endwall 18 and an opposing player may play the game at a second side adjacent the second endwall 20. In the preferred embodiments, the first and second endwall lengths L1, L2 are equivalent but are not so limited.

Figure 3:
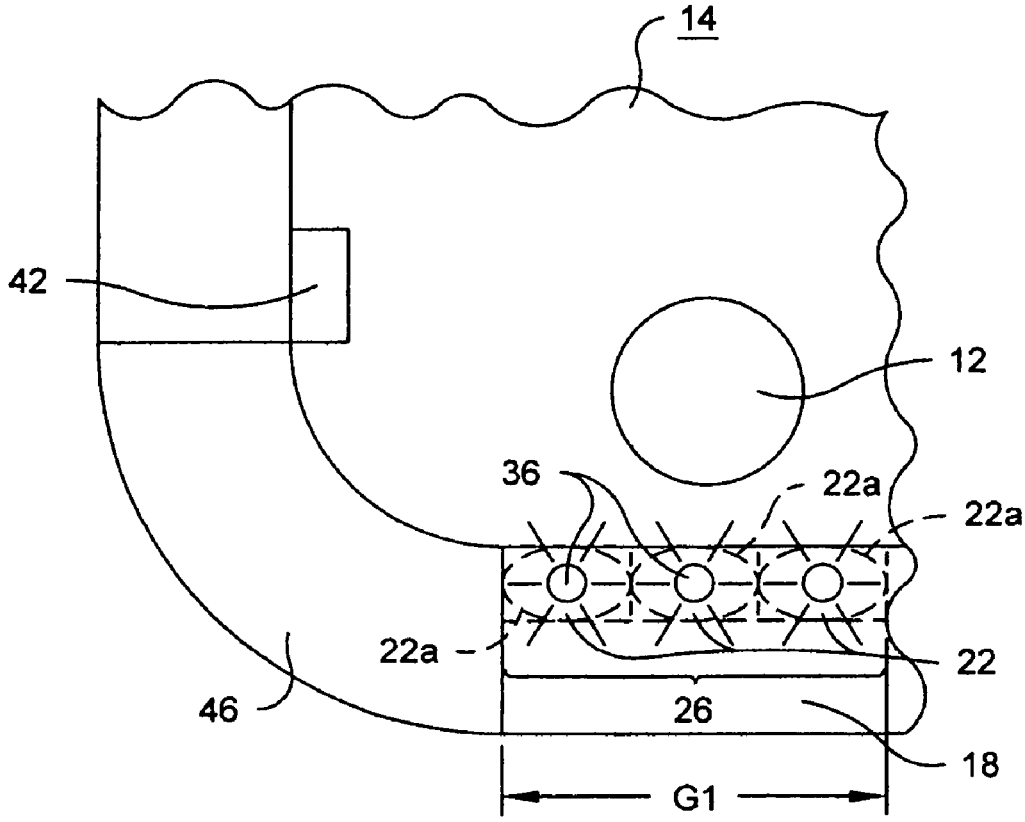
FIG. 3 is a magnified, fragmentary top plan view of a corner of the game table, taken from within line 3 of FIG. 1.

Referring to FIGS. 1–3, in the preferred embodiments, at least one proximity sensor 22 is mounted proximate the first endwall 18. In the preferred embodiments, a plurality of proximity sensors 22 are mounted at spaced locations along the first and second endwalls 18, 20 between the first and second lateral ends. The preferred sensors 22 are mounted to the first and second endwalls 18, 22 on an inner wall 18*a* adjacent the playing surface 14. The proximity sensors 22 preferably sense the presence of the gamepiece 12 if the gamepiece 12 or a portion of the gamepiece 12 is within a predetermined distance of the proximity sensors 22, as will be described in greater detail below. The proximity sensors 22 preferably sense the presence of the gamepiece 12 regardless of how quickly the portion of the gamepiece 12 enters and exits from the predetermined distance from the proximity sensors 22. The game table 10 is not limited to the inclusion of the plurality of proximity sensors 22 and may include a single proximity sensor 22 having nearly any size and shape that is mounted to the first endwall 18.

Referring to FIGS. 2 and 3, in the preferred embodiments, each of the sensors 22 includes a sensing area 22*a* within which the sensor 22 may sense the gamepiece 12. In the preferred embodiment, a gap 24 is created between the first endwall 18 and the playing surface 14 that is preferably large enough to accept a portion of the gamepiece 12 (FIG. 2). The gap 24 is open to the playing surface 14 proximate the inner wall 18*a* of the first endwall 18. The sensor area 22*a* is preferably located within the gap 24 such that the paddle 16, a user's fingers or another object will typically not be sensed by the sensor 22 when these items are positioned proximate the base of the first endwall 18. That is, a portion of the gamepiece 12 preferably enters the gap 24 before the sensor 22 is tripped or senses that a portion of the gamepiece 12 is within the sensor area 22*a*, as will be described in greater detail below.

Referring to FIGS. 1 and 3, a first goal 26 is located along the first endwall 18 and has a first goal length G1 that is adjustable. In the preferred embodiments, each of the plurality of sensors 22 is actuable between an on condition and an off condition. A first bank of the plurality of sensors 22 are in the on condition and the width of the sensor area 22*a* of the sensors of the first bank defines the first goal 26 and the first length G1. In the preferred embodiments, when the sensors 22 or a bank of sensors 22 are in the on condition, the sensors 22 sense when a portion of the gamepiece 12 enters the respective sensor area 22*a* of the first goal 26. Accordingly, the goal length G1 is comprised of the width of the first bank 26 of sensors 22, which are in the on condition. Therefore, when the gamepiece 12 enters the sensor area 22*a* of any of the sensors 22 in the first bank 26, one or more of the sensors 22 senses that the gamepiece 12 is within the sensor area 22*a*. In the preferred embodiments, when playing a game, at least one of the sensors 22 associated with the first endwall 18 is in the on condition and defines the first goal 26 and the first goal length G1. For example, as is shown in FIG. 3, each of the three sensors 22 that are shown in plan view are in the on condition and define the first goal 26 and the first goal length G1.

One having ordinary skill in the art will realize that any number of the plurality of sensors 22 may be actuated to the on or off condition. The sensors 22 along the first endwall 18 that are in the on condition comprise the first bank or first goal 26 and the first goal length G1. One having ordinary skill in the art will also realize that the sensors 22 in the on condition are not necessarily positioned immediately adjacent each other and may be comprised of a plurality of sensors 22 that are separated by another plurality of sensors 22, which are actuated to the off condition. The first goal length G1 in this situation would be comprised of a sum of the widths of the sensing area of each of the sensors 22 that are in the on condition (not shown).

In addition, the first goal 26 and first goal length G1 are adjustable and movable to various positions along the first wall length L1 by actuating specific sensors 22 along the first endwall 18 between the on and off conditions. For example, sensors 22 at first and second lateral ends of the first endwall 18 may be actuated to the on condition at an initial instant to define the first bank and first goal 26. After a predetermined amount of time, the lateral end sensors 22 may be actuated to the off condition and predetermined sensors 22 proximate the middle of the first endwall 18 may be actuated to the on condition-such that the first goal 26 moves to a different location along the endwall 18 during game play. The sensors 22 along the second endwall 20 may be actuated in a similar or a different manner.

Figure 4:
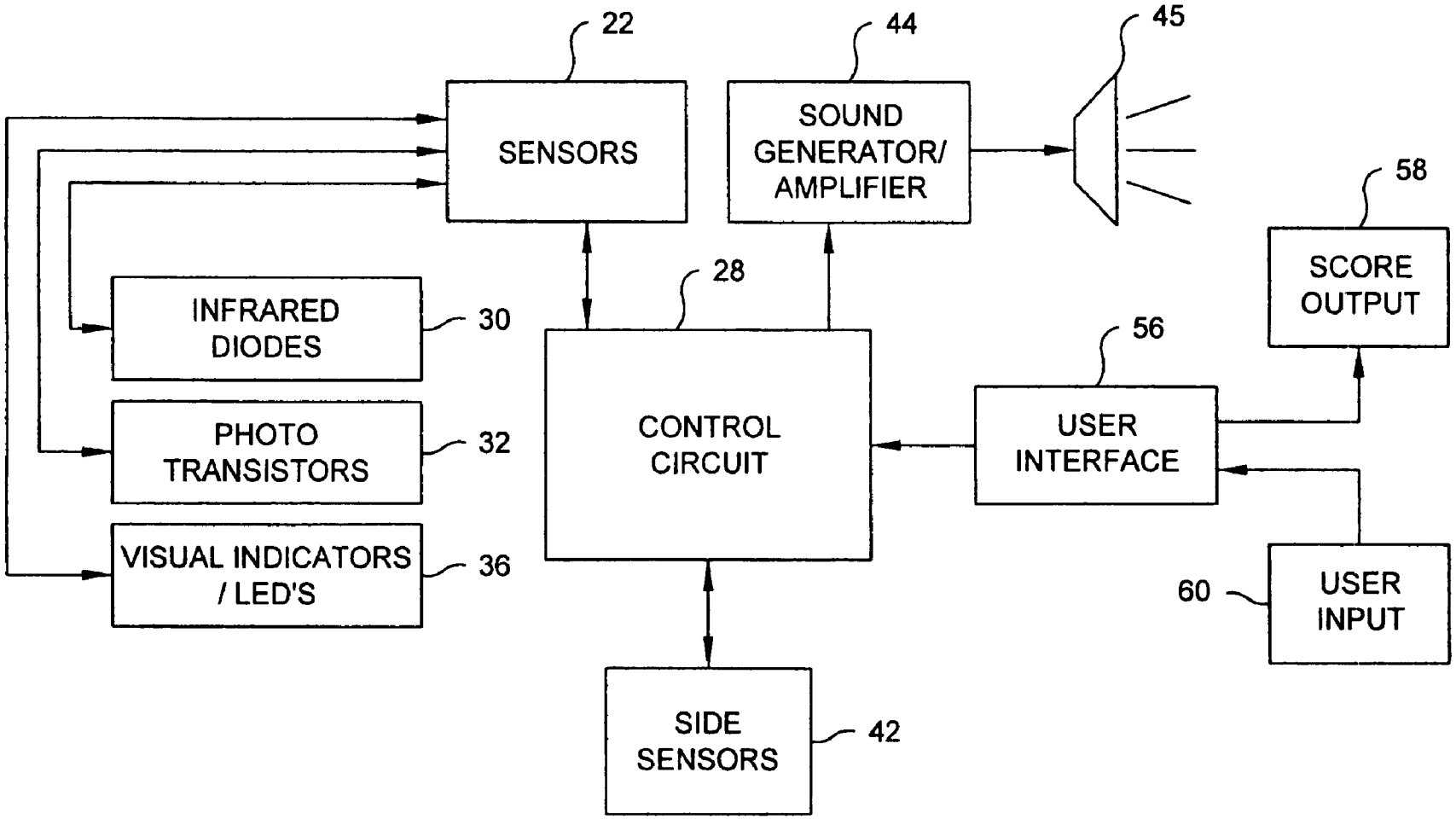
FIG. 4 is a schematic block diagram of a control circuit of the game table of FIG. 1.

Referring to FIGS. 1, 4 and 5, in the preferred embodiments, a control circuit 28 is in communication with the plurality of sensors 22. The control circuit 28 preferably controls the actuation of each of the plurality of sensors 22 between the on and off conditions. That is, based upon a signal from the control circuit 28, each of the sensors 22 is actuated between the on and off conditions. Accordingly, the control circuit 28 is able to control the location of the first goal 26 and the first goal length G1 by actuating the sensors 22 between the on and off conditions. Further, the control circuit 28 is preferably able to change the location of the first goal 26 during game play by changing various sensors 22 along the first endwall 18 between the on and off conditions at predetermined time intervals. One having ordinary skill in the art will realize that the game table 10 is not limited to the inclusion of the control circuit 28 as the sensors 22 may be manually actuated between the on and off conditions. However, the control circuit 28 is preferred such that the sensors 22 are automatically actuated depending upon user input, which frees the user to play the game as opposed to manually actuating the sensors 22.

In the preferred embodiments, power is provided to the game tables 10, 10', the control circuit 28 and other related components from AC power that is directed to a game table 10, 10' fan (not shown) or may be supplied by an AC to DC wall transformer. The AC power is preferably transformed to DC to operate the control circuit 28 and its related components. The game table 10, 10' may also be battery powered or otherwise powered such that the control circuit 28 and its related components are able to control game play, as will be described in greater detail below.

The control circuit 28 is preferably comprised of a microcomputer that contains software, which is used to implement and control various features of the game tables 10, 10'. The control circuit 28 preferably includes software that is able to control the features of the game tables 10, 10' for playing different games, as will be described in greater detail below. The control circuit 28 is not limited to being comprised of a microcomputer and may be comprised of a microprocessor, application specific integrated circuit (ASIC) or other control device that is able to control various features of the game tables 10, 10' for playing different games.

Referring to FIGS. 3 and 4, in the preferred embodiments, each of the sensing areas 22*a* of the sensors 22 are activated only when the associated sensors 22 are in the on condition. Each of the sensors 22 that are in the on condition, transmit a signal to the control circuit 28 when a portion of the gamepiece 12 enters the respective sensing area 22*a*. When playing a preferred game, such as table hockey, when a first player strikes the puck 12 with the paddle 16, the object is to drive the puck 12 into an opposing player's goal 26. Therefore, when the player directs the puck 12 into the first goal or the first bank 26 of sensors 22 that are in the on condition, the puck 12 enters the sensor area 22*a* of at least one of the sensors 22 of the first bank 26 and the respective sensor 22 sends a signal to the control circuit 28. The control circuit 28 counts the number of times a signal is sent from one or more of the sensors 22 in the first bank 26 indicating that a goal has been scored and tabulating a score for the game. One having ordinary skill in the art will realize that the game tables 10, 10' may be configured and adapted as a table hockey table, bubble hockey table, foosball table, pool table, target game table or other similar table for playing a game including nearly any type of gamepiece 12 that is directed toward a first goal 26.

In the preferred embodiments, the proximity sensors 22 are comprised of an infrared diode 30 and a phototransistor 32 with infrared sensitivity mounted to a printed circuit board 34. The printed circuit board 34 is embedded in or mounted to the first endwall 18 adjacent the inner wall 18*a*. The preferred sensor 22 is mounted to the first endwall 18 such that the phototransistor 32 and infrared diode 30 are facing the playing surface 14 within the gap 24. Specifically, the phototransistor 32 and infrared diode 30 are preferably mounted approximately one half inch (½") above the playing surface 14 within the gap 24. However, the phototransistor 32 and infrared diode 30 are not limited to being mounted one half inch above the playing surface 14 and may be mounted nearly any distance above the playing surface 14 that permits the gamepiece 12 to enter the gap 24 and, preferably, for the sensor area 22*a* of each of the plurality of sensors 22 to be located within the gap 24 outwardly from the inner surface 18*a* of the first endwall 18.

In the preferred embodiment, the phototransistor 32 and infrared diode 30 aim downwardly toward the playing surface 14. The gap 24 preferably not only allows a portion of the gamepiece 12 to enter therein but provides protection to the phototransistor 32 and infrared diode 30 from ambient light, which may impact the performance of the sensor 22, as is obvious to one having ordinary skill in the art. The preferred phototransistor 32 and infrared diode 30 are aimed at the playing surface 14 within the gap 24 at a sensor angle Δ slightly off normal and toward each other, which is preferably approximately five degrees (5°). The phototransistor 32 preferably senses reflected infrared light from the infrared diode 30 in normal operation in the on condition. When at least a portion of the gamepiece 12 enters the sensor area 22*a* of a sensor 22 in the on condition, the phototransistor 32 senses an absence or change in the reflected light from the infrared diode 30 and sends a signal to the control circuit 28 indicating that at least a portion of the gamepiece 12 has entered the sensing area 22*a* and a goal has therefore been scored. Black heat shrink tubing (not shown) may be fitted around the phototransistors 32 and infrared diodes 30 to aid in restricting the sensing area 22*a*, to minimize the change of interaction with nearby sensors 22 and to minimize the impact of ambient light on the sensing process, as will be understood by one having ordinary skill in the art. However, the sensors 22 are not limited to the inclusion of heat shrink tubing.

In the preferred embodiments, the sensing area 22*a* is comprised of a one inch (1") diameter circle that projects downwardly from the associated sensor 22 onto the playing surface 14 within the gap 24. The sensing area 22*a* is not limited to being comprised of a one inch diameter circle on the playing surface 14 and may have nearly any size and take on nearly any shape depending upon the game being played and the various parameters of the game, as will be understood by one having ordinary skill in the art. Preferably, if any portion of the gamepiece 12 enters the sensing area 22*a*, the sensor 22 senses the presence of the gamepiece 12 and sends a signal to the control circuit 28. The sensor 22 preferably sends the signal to the control circuit 28 regardless of how long the portion of the gamepiece 12 is positioned in the sensing area 22*a*.

The plurality of sensors 22 are not limited to being comprised of the infrared diode 30 and phototransistor 32 mounted to the printed circuit board 34. For example, the sensors 22 may be comprised of mechanical switches, touch boards/force sensors, vibration sensors, capacitive sensors and/or optical sensors. In addition, the sensors 22 may be comprised of nearly any combination of the above-listed sensors. The sensors 22 may be comprised of nearly any proximity sensor that is able to provide nearly any type of signal, be it electrical or mechanical, indicating that a portion of the gamepiece 12 has entered the sensing area 22*a*.

Referring to FIGS. 1–3, in the preferred embodiments, a visual indicator 36 is mounted to an opposite side of the printed circuit board 34 from the infrared diode 30 and phototransistor 32. The visual indicator 36 is preferably comprised of a light emitting diode (LED) 36 that emits visible light when the associated sensor 22 is in the on condition. Conversely, when the associated sensor 22 is in the off condition, the LED 36 does not emit light, indicating that the associated sensor 22 is in the off condition. The preferred sensor 22 includes the LED 36 to indicate to the user and the opposing player which of the plurality of sensors 22 is in the on condition and, in specific games, where the first goal 26 is located along the first endwall 18 and the first goal length G1. The sensors 22 are not limited to the LED's 36 to indicate which sensors 22 are in the on condition and the sensors 22 may be fitted with a light bar or light pipe (not shown) that extends along the width of the sensors 22 proximate the playing surface 14 to indicate if the specific sensor 22 is in the on condition or the sensors 22 may include other different indicating devices, for example, mechanical flags. For example, the light pipe may mount over each of the LED's 36 such that the entire length of a goal is visible. In addition, the preferred game tables 10, 10' are able to move the first goal 26 during game play through predetermined programming in the control circuit 28. Therefore, a user and the opposing player are able to determine the location of the first goal 26 by identifying the LED's 36 that are emitting light. One having ordinary skill in the art will realize that the sensors 22 are not limited to the inclusion of the LED 36 and may include nearly any visual indicator 36, for example a mechanical flag that indicates which of the sensors 22 are in the on condition.

Referring to FIGS. 1 and 5, in the preferred embodiments, the game tables 10, 10' also include at least one sidewall 38 located between a first lateral end of the first endwall 18 and a first lateral end of the second endwall 20. At least one side sensor 42 is mounted proximate to the sidewall 38 and is in communication with the control circuit 28. The side sensor 42 transmits a signal to the control circuit 28 when at least a portion of the gamepiece 12 is in close proximity to the sidewall 38. In the preferred embodiments, the side sensor 42 is comprised of nearly any visual sensor that may be comprised of any of the various types of sensors 22 associated with the first endwall 18 or like sensing mechanisms. A similar side sensor 42 is located proximate endwall 20 along the sidewall 38. The side sensors 42 preferably sense when the gamepiece 12 breaks a visual indication between two side sensors 42 mounted at opposing ends of the sidewall 38. The preferred side sensors 42 are comprised of infrared (IR) transmitters mounted at opposing ends of the sidewall 38. The side sensors 42 are not limited to being comprised of visual sensors or IR transmitters and may be comprised of nearly any sensors that are able to indicate when the gamepiece 12 comes into close proximity with the sidewall 38 or, preferably, to send a signal to the control circuit 28 when the gamepiece 12 comes within close proximity of the sidewall 38, for example, mechanical sensors, capacitance sensors, optical sensors or other different sensors that are able to detect the presence of at least a portion of the gamepiece 12 proximate the sidewalls 38, 40.

In the preferred embodiment, the game tables 10, 10' include the first sidewall 38 and a second sidewall 40 that extend between second ends of the first and second endwalls 18, 20. The first and second sidewalls 38, 40 preferably extend perpendicularly (upwardly) from and above the playing surface 14 such that the gamepiece 12 is retained on the playing surface 14 and may be deflected off the sidewalls 38, 40 as the gamepiece 12 slides or rolls along the playing surface 14. A pair of side sensors 42 is also located along the sidewall 40, which are preferably able to sense the presence of at least a portion gamepiece 12 along the length of the sidewalls 38, 40. The game tables 10, 10' of the first and second preferred embodiments may be configured to include sensors 22 along each of the endwalls and sidewalls 18, 20, 38, 40 such that a goal or target may be positioned on any one of the endwalls and/or sidewalls 18, 20, 38, 40. The game tables 10, 10' are not limited to having four walls 18, 20, 38, 40 and may include nearly any number of walls or a single circular or curving wall that permit game play on the playing surface 14 using a gamepiece 12. In addition, the individual walls 18, 20, 38, 40 are not limited to being straight and may be curving, arcuate, serrated or otherwise shaped to accommodate various types of games that may be played on the game tables 10, 10'. For example, a bumper pool table often has an octagonal-shape or is circular and the preferred game tables 10, 10' may be adapted for these types of tables, as would be obvious to one having ordinary skill in the art.

In the preferred embodiments, the side sensors 42 are comprised of the IR transmitters 42 that are mounted to the ends of the sidewalls 38, 40. The IR transmitters 42 are preferably mounted as close to the playing surface 14 and ends of the sidewalls 38, 40 as possible and a line of sight is created between the opposing side sensors 42. Accordingly, when the line of sight is broken between the two opposing side sensors 42, preferably by a portion of the gamepiece 12, the side sensors 42 send a signal to the control circuit 28, indicating that the gamepiece 12 is proximate at least one of the sidewalls 38, 40.

Referring to FIGS. 1, 4 and 5, in the preferred embodiments, a sound generator 44 is in communication with the control circuit 28. In the preferred embodiments, the sound generator 44 is comprised of a digital sound playback chip used in conjunction with the control circuit 28, an amplifier 44 and a speaker 45. However, the sound generator 44 is not so limited to these components and may be comprised of nearly any sound emitting device that may be directed to emit sounds based upon input from the control circuit 28. The control circuit 28 preferably transmits a signal to the sound generator 44 upon receipt of a signal from one of side sensors 42 or from one of the sensors 22. The sound generator 44 then emits a sound based upon the game being played, the amount of time the gamepiece 12 is positioned in the sensing area 22*a* and/or whether the signal originated from one of the side sensors 42 of one of the sensors 22. For example, the sound generator 44 may produce a whooshing sound when a signal from the side sensor 42 is provided to the control circuit 28 and may produce the sound of applause or "score" when a signal that a goal has been scored in the first goal 26 is transmitted to the control circuit 28.

The control circuit 28 may direct the sound generator 44 to emit sounds randomly, as part of the game or in response to game activities and the sounds may be of nearly any time, for example, voices, recorded sounds or computer generated sounds. The random sounds may be played during inactive game periods to attract players to the game or may be played during game play to encourage, coach, cheer, discourage and/or heckle players. Sounds may also be emitted from the sound generator 44 to guide players through a game setup, to direct players during game play, to indicate the start of a game, to indicate that a goal has been scored, to indicate a shot has been taken but a goal has not been scored, to indicate that an object is moving close to the one of the sidewalls 38, 40, to indicate a penalty or other like events during or outside of the game. The preferred game tables 10, 10' include a volume control or other sound control (not shown) that permits a user to reduce the volume of the sounds emitted by the sound generator 44 or to completely eliminate the sounds.

The amount of time that a line of sight between the side sensors 42 is broken may be utilized to measure the speed of the gamepiece 12 as the gamepiece 12 is propelled along the playing surface 14. The control circuit 28 may select, create or modify the sound that emanates from the sound generator 44 based upon the approximate speed of the gamepiece 12. For example, if the line of sight between the side sensors 42 is broken for a prolonged period of time, the sound generator 44 may emit a low frequency and/or low volume sound and if the line of sight between the side sensors 42 is broken for comparatively a short period of time, the sound generator 44 may emit a relatively high frequency or high volume sound. The side sensors 42 may also be utilized to add a scoring element to the game, for example, if a goal is scored in one of the first goal 26 by banking the gamepiece 12 off of one or both of the sidewalls 38, 40, a bonus value may be assigned to the goal by the control circuit 28 due to the degree of difficulty.

Referring to FIGS. 1 and 5, in the preferred embodiments, the game tables 10, 10' include the first and second endwalls 18, 20, the first and second sidewalls 38, 40, the playing surface 14 and four corners 46 that connect the first and second endwalls 18, 20 to the first and second sidewalls 38, 40. Each of the first and second endwalls 18, 20, first and second sidewalls 38, 40 and corners 46 extend at least slightly upwardly and generally perpendicularly from the playing surface 14 such that the gamepiece 12 is retained on the playing surface 14 during game play, which is conducive to continuous game play, as will be described in greater detail below.

The preferred game tables 10, 10' include a plurality of sensors 22 mounted to the second endwall 20 that are actuable between the on and off conditions. Actuating one or more of the plurality of sensors 22 along the second endwall 20 to the on condition defines a second goal 48 and a second goal length G2. In the preferred table hockey game, a first player stands adjacent the first endwall 18 to protect the first goal 26 and a second player stands adjacent the second endwall 20 to protect the second goal 48. The first and second players attempt to drive the puck 12 into the first or second goals 26, 48. The players are able to identify the first and second goals 26, 48 by identifying the illuminated LED's 36 mounted to an opposing endwall 18, 20. In addition, the player is able to identify the location and size of their own goal 26, 48 by identifying the width of the illuminated LED's 36 on the endwall 18, 20 adjacent their playing position.

During game play with the preferred table hockey table 10, 10', the sound generator 44 may emit sounds that are typically unique to hockey or table hockey games. For example, when a player shoots the puck 12 and misses the goal 26, the control circuit 28 may send a signal to the sound generator 44 to emit a heckling sound of a "clanging" sound indicating that the player has hit the post, as in a conventional hockey game. In addition, the sound generator 44 may be directed to emit a "clunka-clunk" sound when a goal is scored in the preferred table hockey game to give the virtual game a similar audible feel to the conventional table hockey game.

In the preferred table hockey game table 10, 10' configuration, the sensing area 22*a* is comprised of the preferred one inch diameter circle projected onto the playing surface 14, the gamepiece 12 is comprised of the puck 12 having a diameter of approximately two and one-half inches (2½") and the sensors 22 are preferably mounted two inches (2") apart along the first and second endwalls 18, 22. Accordingly, in the preferred table hockey game table 10, 10' configuration, the puck 12 is typically unable to enter the gap 24 at a location between at least two sensors 22 that are in the on condition, without at least one of the sensors 22 sensing the presence of at least a portion of the puck 12 and sending a signal to the control circuit 28, indicating that a goal has been scored.

Referring to FIG. 5, in the second preferred embodiment, the sensors 22 may be retrofit to or mounted to the first and second endwalls 18, 20 of an existing game table 10'. In the second preferred embodiment, the existing game table 10' is comprised of a table hockey table 10' with a first fixed length goal 50 in the first endwall 18 and a second fixed length goal 52 in the second endwall 20. The existing table hockey table 10' is retrofit with sensors 22 along its first and second endwalls 18, 20. The first and second fixed length goals 50, 52 are blocked by plugs 54 that close the first and second fixed length goals 50, 52. The existing game table 10' of the second preferred embodiment is then outfitted with the control circuit 28, sound generator 44 and side sensors 42. The first and second goals 26, 48 of the second preferred embodiment are defined by actuating the sensors 22 between the on and off conditions, similar to the operation of the game table 10 of the first preferred embodiment. In addition, the first and second goals 26, 48 of the second preferred embodiment may be defined by inserting one of the plugs 54 into the fixed length goals 50, 52 to adjust the size of the fixed length goals 50, 52. The existing game table 10' of the second preferred embodiment is not limited to the inclusion of the plugs 54 to block the first and second fixed length goals 50, 52 and the fixed length goals 50, 52 may be left open such that the gamepiece or puck 12 drops into the goals 50, 52 during game play.

Referring to FIG. 1, in operation of the first and second preferred embodiments of the game tables 10, 10', the control circuit 28 activates a first bank or first goal 26 from the plurality of sensors 22 on the first endwall 18 and actuates the remainder of the sensors 22 on the first endwall 18 to the off condition, if they are not already off. A player is positioned adjacent the second endwall 20 and applies a force to the gamepiece 12, propelling the gamepiece 12 toward the first endwall 18. If and when a portion of the gamepiece 12 enters the sensing area 22*a* of at least one of the sensors 22 of the first goal 26, a signal is transmitted to the control circuit 28.

In the preferred table hockey game, the control circuit 28 activates the second goal 48 on the second endwall 26 such that some of the sensors 22 of the second goal 26, 48 are in the on condition and the remainder of the sensors 22 on the second endwall 20 are in the off condition. A second player is positioned adjacent the first endwall 18 and the players utilize the paddles 16 to direct the puck 12 toward the opposing goal 26, 48 and to defend their own goal 26, 48 in the usual manner. The players preferably score a goal by directing the puck 12 into their opponent's goal 26, 48. If and when at least a portion of the puck 12 enters the sensing area 22*a* of one of the goals 26, 48, a signal is sent to the control circuit 28, which records a goal or point of the appropriate player and may send a signal to the sound generator 44 to play a sound indicating that a goal was scored.

In a variation of the game of the preferred embodiments, when the player positioned adjacent the second endwall 20 scores a goal in the first goal 26, a signal is sent from the respective sensor 22 of the first goal 26 to the control circuit 28. The control circuit 28 in turn sends a signal to the sensor 22 that indicated a goal was scored to actuate the sensor 22 to the off condition. Accordingly, the game may be handicapped in this manner such that the player scored upon has a subsequent first goal 26 and first goal length G1 that is smaller than the first goal length G1 was before the goal is scored. Therefore, the opposing player has a smaller first goal 26 to aim at and the player that was scored upon has a smaller first goal 26 to defend.

In a similar game, the control circuit 28 actuates all of the sensors 22 associated with the first and second endwalls 18, 20 to the on condition at the beginning of the game. Therefore, the first goal 26 has a first goal length G1 that is equivalent to the first wall length L1 and the second goal 48 has a second goal length G2 that is equivalent to the second wall length L2 at the beginning of the game. Each time an opposing player scores a goal in the first or second goals 26, 48, the control circuit 28 sends a signal to actuate the sensor 22 within which the goal is scored to the off condition. The object of such a game may be to score a goal in each one of the sensors 22 in an opponent's endwall 18, 20 until all of the sensors 22 are actuated to the off condition by the control circuit 28.

In another alternative game of the preferred embodiments, the first bank or first goal 26 may be modified after a predetermined time such that at least one of the sensors 22 of the first goal 26 that is in an on condition at an initial time is actuated to an off condition after a predetermined amount of time has elapsed. In addition, at the predetermined time, one of the sensors 22 on the first endwall 18 that is in the off condition is actuated by the control circuit 28 to the on condition such that the first goal length G1 does not change from the initial time to the predetermined time. Therefore, the first bank or first goal 26 moves along the first wall length L1 during game play. The first goal 26 may be actuated by the control circuit 28 to move in nearly any pattern along the first endwall 18 during game play or in a preselected or a random pattern on the first endwall 18. The sensors 22 and second goal 48 may be controlled by the control circuit 28 in a similar manner to the sensors 22 on the first endwall 18. Modifying the location of the first and second goals 26, 48 along the first and second endwalls 18, 20 may also be conducive to individual play or practice where an individual player attempts to strike a moving goal 26, 48 with the gamepiece 12 while standing at an opposite endwall 18, 20. Other ways to control the play of a game by variations to the goals 26, 48 will be apparent to those skilled in the art.

Referring to FIGS. 1, 4 and 5, in the preferred embodiments, a user interface 56 is mounted to the game tables 10, 10' and includes at least a score output 58 and a user input 60. From the user interface 56, the user or player may select a desired game to be played, the number of players, game options, the type of goals 26, 48 and may view a score of the game at the score output 58. The score output 58 may provide time status during play, the time left in a game, the time left in a segment of play, the number of players, the duration of a penalty, the score of the game or any number of variations related to the game being played. The user interface 56 may include control switches, control buttons and nearly any type of display as the score output 58. In the preferred embodiments, the user input 60 includes at least one momentary push button (not shown) and the score output 58 includes at least one output LED (not shown), but the user input 60 and score output 58 are not so limited. The game tables 10, 10' are also not limited to the inclusion of the user interface 56, including the score output 58 and the user input 60, however, the user interface 56 is preferred such that the user or player may select various types of games, the number of players or other like options when utilizing the game tables 10, 10'. In addition, the score output 58 is preferred to visually display a score of the game being played, the amount of time remaining in a game, the number of players involved in the game or other like values related to game play.

The user interface 56 may be utilized by a user to specifically control the sensors 22 for creating and controlling the first and second goals 26, 48 of the preferred table hockey game. For example, the user may select a game option through the user interface 56 such that the first goal 26 is comprised of four sensors 22 and the first goal 26 will move in a smooth manner along the first endwall 18 during game play. When the user selects this type of game option, the user interface 56 may direct the control circuit 28 to actuate four of the centrally located sensors 22 along the first endwall 18 to the on condition, which comprise the first goal 26. The four LED's 36 associated with these sensors 22 would be actuated to illuminate and the players would be able to identify the size and location of the first goal 26. Once game play begins, the control circuit 28 would actuate one of the end sensors 22 of the first goal 26 to the off condition and actuate a sensor 22 adjacent the opposite end sensor 22 of the first goal 26 to the on condition such that the first goal 26 moves along the first endwall 18 as time elapses during the game. The first goal 26 would effectively move two inches (2") along the first endwall 18 in the preferred table hockey table 10, 10' configuration, based on the preferred sensors 22 being mounted at two inch (2") increments along the first endwall 18. The control circuit 28 may continuously actuate the sensors 22 along the first endwall 18 in this manner until an end sensor 22 along the first endwall 18 is in the on condition and then actuate the first goal 26 to move in the opposite direction along the first endwall 18 or to cross over or transition incrementally to the opposite end of the first endwall 18. The sensors 22 mounted to the second endwall 20 could be similarly controlled by the control circuit 28 based upon inputs from the user at the user input 60 and user interface 56.

Based upon the above disclosure, one having ordinary skill in the art will realize that a significant number of combinations of the size, position and movement of the first and second goals 26, 48 may be developed to produce various games and situations in the games. The combinations may include small, medium, large and random sized goals 26, 48, smooth movement of the goals 26, 48, jumping movement of the goals 26, 48, random movement of the goals 26, 48 or other different sizes or movements of the goals 26, 48 resulting in various game types and variations. In addition, if the first or second goal 26, 48 is defined by at least two or more sensors 22 in the on condition, the sensor 22 that sends the signal to the control circuit 28 indicating that a goal has been scored may be actuated by the control circuit 28 to blink or flash its associated LED 36. The blinking or flashing of the LED 36 associated with the sensor 22 where the goal was scored provides a visual indication to a player where the goal was scored in the sometimes fast paced table games that are played using the preferred game tables 10, 10'.

The preferred game tables 10, 10' also allow for convenient solitary or single play. For example, a single player may play an individual game of table hockey on the preferred table hockey table 10, 10' because the puck 12 is preferably, constantly contained on the playing surface 14 between the enwalls 18, 20, sidewalls 38, 40 and corners 46. The puck 12 typically deflects off of the walls 18, 20, 38, 40 and corners 46, eventually returning to the single player during game play. The preferred table hockey tables 10, 10' do not include exposed goals 50, 52 for the puck 12 to enter when a goal is scored, therefore, the puck 12 is retained on the playing surface 14 during game play. Because of this feature, game play can be continuous and allows for solitary play. In the typical solitary game, the object for the solo player may be to score a goal in the opposing goal 26, 48 as many times as possible in a given time period or to impact all of the sensors 22 on the opposing endwall 18, 20, as will be understood by one having ordinary skill in the art.

In the preferred game tables 10, 10', the control circuit 28 is able to disallow certain goals that may be scored depending upon how and when the gamepiece 12 strikes one of the goals 26, 48. For example, in the typical table hockey game, the gamepiece 12 may move along the radius of one of the corners 46 and travel along the length of either of the endwalls 18, 20, potentially striking or entering into the sensor area 22*a* of each of the sensors 22 in the on condition along the respective endwall 18, 20. In a conventional table hockey game, a goal is typically not scored in this situation because the puck 12 slides in front of the open goal 50, 52 or deflects off of one of the posts on the goal 50, 52 and moves away from the goal 50, 52. Accordingly, the control circuit 28 may disallow a goal scored in this manner by detecting that a signal has been transmitted from a series of successive sensors 22 in a short period of time indicating that the gamepiece 12 is sliding horizontally along the endwall 18, 20 or by detecting the amount of time that the gamepiece 12 lingers in the sensor area 22*a* of the sensors 22.

In a preferred game, generally referred to as knock out, each of the sensors 22 on at least one of the endwalls 18, 20 is actuated to the on condition. A player then propels the gamepiece 12 toward the opposing endwall 18, 20 using the paddle 16 or their hand in an attempt to strike and knock out one of the sensors 22. When one of the sensors 22 that is in the on condition is struck or knocked out, a signal is sent to the control circuit 28 and the sensor 22 that was struck or knocked out is actuated to the off condition. The object of the knock out game is to strike or knock out each of the sensors 22 on the opposing endwall 18, 20 such that all of the sensors 22 are in the off condition. As will be understood by one having ordinary skill in the art, knock out may be played by one or two players and the sensors may be actuated between the off and on conditions, depending upon user preferences and the game variation being played.

The side sensors 42 may be utilized to impact the scoring of various games played on the preferred game tables 10, 10' depending upon signals that the side sensors 42 transmit to the control circuit 28. For example, the control circuit 28 may save the number of times that the side sensors 42 transmit a signal before the gamepiece 12 strikes one of the endwalls 18, 20. This calculation is an indication of the number of times that the gamepiece 12 deflects or banks off of the sidewalls 38, 40 before contacting one of the endwalls 18, 20. The control circuit 28 may enhance a game score depending upon the number of times that the gamepiece 12 deflects or banks off of the sidewalls 38, 40 before impacting one of the endwalls 18, 20, indicating a degree of difficulty for scoring in such a manner. That is, deflecting or banking the gamepiece off of the sidewalls 38, 40 numerous times before scoring at the endwalls 18, 20 is generally considered a more difficult manner to score and the control circuit 28 may enhance the score of a player when a goal is scored in this manner. For example, when playing the knockout game, if a player deflects or banks the gamepiece 12 numerous times off of the sidewalls 38, 40 prior to striking or knocking out on of the sensors 22 on an opposing endwall 18, 20, this manner of knocking out a sensor 22 is generally considered more difficult than sending the gamepiece 12 directly across the playing surface 14 to knock out a sensor 22. Therefore, the control circuit 28 may enhance the score when the sensor 22 is knocked out by deflecting or banking the gamepiece 12 off of the sidewalls 38, 40 one or more times. For example, the control circuit 28 may calculate a triple score if the side sensors 42 send three signals to the control circuit 28 before the gamepiece 12 strikes or knocks out one of the sensors 22, indicating that the gamepiece 12 deflected or banked off of the sidewalls 38, 40 three times prior to knocking out one of the sensors 22.

The game tables 10, 10' are also conveniently configured for continuous play due to the lack of open goals 50, 52 that are typical in a conventional game table. For example, the user may have an option to play the game in a continuous play mode of a standard play mode. In the continuous play mode, the game continues after a goal has been scored as long as the gamepiece 12 remains in play on the playing surface 14, without pause. In this way, game play is never stopped while there is still time left in the game and multiple goals may be scored by each player or a single player during a short period of time. The continuous mode may potentially raise the game risk and excitement by not allowing each player to pause and gather themselves following each goal. In the standard mode, game play is typically stopped for a period of time after each goal is scored. The pause in game play allows each player time to gather themselves after each goal and is typically considered standard because this mode simulates standard ice hockey, soccer, football, field hockey and other games where play stops after a goal is scored while players moved into position for game play to continue. The game tables 10, 10' are not limited to the continuous and standard modes and may be configures to operated in other modes or in a combination mode where game play is paused for a predetermined amount of time after a predetermined number of total goals are scored or a predetermined number of goals are scored in a specific goal 26, 48.

It will be appreciated by those skilled in the art that changes could be made to the embodiment described above without departing from the broad inventive concept thereof. For example, there are innumerable games that may be developed and played on the preferred game table 10, 10', as will be understood by one having ordinary skill in the art. It is understood, therefore, that the invention described in the present application is not limited to the particular embodiment disclosed, but is intended to cover modifications within the spirit and scope of the present invention, as defined by the appended claims.

We claim:

1. A method of playing a table game on a game table having a gamepiece, the game table including a first endwall, a second endwall, a first sidewall, a second sidewall and a playing surface, a first plurality of sensors mounted proximate to the first endwall and a second plurality of sensors mounted proximate to the second endwall, the first and second plurality of sensors each being actuable between an on condition and an off condition, a control circuit being in communication with the first and second plurality of sensors, the method comprising the steps of:

a) activating at least one of the first plurality of sensors to the on condition defining a first goal having a first goal length comprised of a width of a sensing area of the at least one of the first plurality of sensors in the on condition;

b) actuating a remainder of the first plurality of sensors to the off condition;

c) applying a force to the gamepiece propelling the gamepiece toward the first endwall;

d) transmitting a signal to the control circuit when the gamepiece enters a sensing area of the first goal such that the control circuit records a goal; and e) disallowing the goal if the control circuit one of receives signals from a series of successive sensors of the first goal in a short period of time and detects that the gamepiece lingered in the first goal for longer than a predetermined amount of time, indicating that the gamepiece has traveled along a length of the first endwall.

2. The method of claim 1 wherein the at least one of the first plurality of sensors in the on condition of step (a) comprises a first sensor and a second sensor, the first sensor being positioned adjacent the second sensor along the first endwall, the first sensor transmitting a first signal and the second sensor transmitting a second signal to the control circuit in step (d) in a short period of time, the control circuit recording two goals in step (d) and the control circuit disallowing the two goals in step (e).

3. The method of claim 1 wherein the at least one of the first plurality of sensors in the on condition of step (a) comprises a first sensor and a second sensor, the first sensor being positioned adjacent the second sensor along the first endwall, the first sensor transmitting a first signal and the second sensor transmitting a second signal to the control circuit in step (d) in a short period of time, the control circuit recording two goals in step (d) and the control circuit disallowing one of the two goals in step (e).

* * * * *